United States Patent [19]

DeBaun et al.

[11] Patent Number: 4,542,875

[45] Date of Patent: Sep. 24, 1985

[54] RIM PROTECTOR FOR HANGING PLATES

[76] Inventors: William A. DeBaun; Linda M. DeBaun, both of 6011 Short St., Yorba Linda, Calif. 92686

[21] Appl. No.: 508,018

[22] Filed: Jun. 27, 1983

[51] Int. Cl.[4] ..... A47G 1/16

[52] U.S. Cl. ..... 248/491; 248/316.7

[58] Field of Search ..... 248/491, 490, 345.1, 248/316.1, 316.3, 316.4, 316.6, 316.7, 316.8, 316.9, 221.1; 138/96 R; 128/132 R, 149, 20; 24/564

[56] References Cited

U.S. PATENT DOCUMENTS

| | | | |
|---|---|---|---|
| 1,333,692 | 3/1920 | Wester | 248/215 |
| 2,022,169 | 11/1935 | Yamashiro | 24/564 |
| 2,083,077 | 6/1937 | Mayer | 24/564 |
| 2,145,705 | 1/1939 | Wodtke | 138/96 R |
| 2,567,926 | 9/1951 | Dunkelberger | 128/132 R |
| 2,656,140 | 10/1953 | Petruschell | 248/316.9 |
| 3,105,666 | 10/1963 | Orr | 248/316.6 |
| 3,897,926 | 8/1975 | Silver | 248/221.1 |
| 3,992,570 | 11/1976 | Beinhaur | 138/96 R |
| 4,037,815 | 7/1977 | DeLano | 248/316.6 |
| 4,106,742 | 8/1978 | Miller et al. | 248/491 |
| 4,182,505 | 1/1980 | Cobin | 248/345.1 |
| 4,215,838 | 8/1980 | Gullota | 248/316.7 |

*Primary Examiner*—Ramon S. Britts
*Assistant Examiner*—Ramon O. Ramirez
*Attorney, Agent, or Firm*—Francis X. LoJacono

[57] ABSTRACT

A protective boot in combination with a dish or plate-mounting bracket formed to be mounted to the free hook ends of the bracket, whereby the boots directly engage the annular peripheral edge of a collector-type dish or plate to be hung for display, so as not to cause wear or damage thereto. The boot is formed from a soft, pliable, plastic material defining an elongated tapered body having a tapered central bore formed therein to readily receive the hook end of the bracket in a fixed manner.

1 Claim, 5 Drawing Figures

RIM PROTECTOR FOR HANGING PLATES

BACKGROUND OF THE INVENTION

The present invention relates generally to devices that are employed for hanging dishes or plates of the collector variety which are primarily displayed to add to the decor of rooms, rather than to serve food. More particularly, the invention relates to a protective boot which is positioned over the engaging end of a typical plate-hanger unit. There are many known plate-hanger devices that have been and are presently being used in conjunction with hanging plates of this character.

However, these known devices are designed to clamp or engage the peripheral edge of a plate without any protection to the plate itself, particularly to the edge thereof. Many expensive collector-type plates can readily lose their value if they are damaged by scratching or chipping, which is very often a problem with the known mounting devices.

SUMMARY AND OBJECTS OF THE INVENTION

The present invention provides a means by which known types of plate-hanging devices can be used without the risk of damage or wear to the plates as is often presently the case.

It is thus an important object of the present invention to provide a protective device that is adaptable for use in conjunction with known plate mounting or supporting devices, whereby the devices need not be altered to accommodate the present invention.

Another object of the invention is to provide a rim protector for hanging plates wherein the protector defines a small protective boot which is formed as an elongated finger-like cover of soft plastic that is adapted to fit over the hook end of a mounting bracket, whereby the edge of the plate is cradled in the boot so as not to make direct contact with the bracket.

Still another object of the invention is to provide a protective device of this character wherein the boot is formed having an elongated taper and an enlarged annular ring which allow the boot to bend and flex to accommodate for various sizes and thicknesses of plates to be mounted, the shape of the boot allowing the plate rim to engage the narrow tip end along the front portion of the plate, with the enlarged annular ring member engaging the rim of the plate, whereby as little contact as possible is made with the metal portion of the hanger device.

It is still another object of the invention to provide a protective device of this character that is easily mounted to most known plate hangers.

A further object of the invention is to provide a protective device of this character that is easily mounted to most known plate hangers.

It is a further object of the invention to provide a protective device for decorator-type plates that is relatively inexpensive to manufacture, and is simple but rugged in construction so as to provide long-wearing properties.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
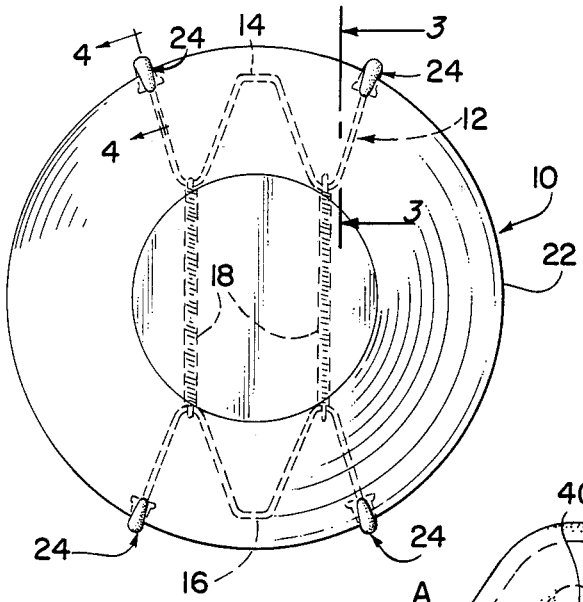
FIG. 1 is a front-elevational view of a plate with a typical hanger or mounting device attached thereto with the present invention shown mounted to the claws of the hanger so as to engage the rim of the plate at four locations.

Referring to the drawings and more particularly to FIG. 1, there is shown a plate, generally indicated at 10, representing a collector-type plate which is hung for display. One of the principal means for displaying such a plate is by use of mounting or hanger brackets, as generally designated at 12. The mounting bracket 12 illustrated in FIG. 1, which is well known in the art and is widely used, comprises a pair of bracket sections 14 and 16 which are held in a fixed position relative to plate 10 by means of a pair of spring members 18.

Each bracket section is formed having a substantially W-shaped configuration and having oppositely disposed claw members 20. The brackets are positioned on the back side of the plate one above the other, each respective claw member being bent forwardly and downwardly so as to hook over the peripheral edge or rim 22 of the plate. With the known devices prior to the present invention, these claws would directly engage the rim of a plate, causing wear and sometimes damage by scratching or chipping which would result in loss of value to the plate.

Figure 2:
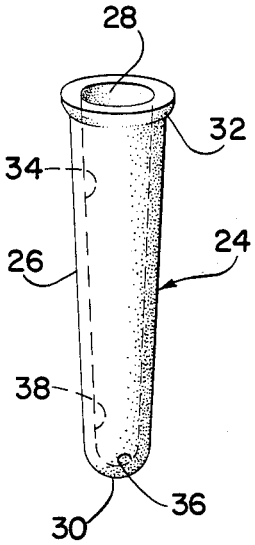
FIG. 2 is a perspective view of the present invention which defines a protective boot.

Accordingly, the present invention comprises a protective device, indicated generally at 24, adapted to be easily mounted over the claw ends 20 of brackets 12. The protective device is formed as an elongated sleeve 26 made from a soft flexible plastic or rubber-like material defining a boot having an enlarged open end 28 and a reduced-diameter closed end. Hence, the body of the sleeve is gradually tapered from the open end to the closed end 30, as illustrated both in FIGS. 2 and 5.

Figure 4:
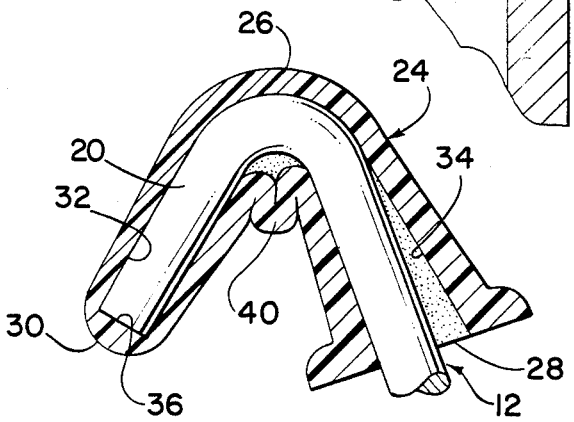
FIG. 4 is an enlarged cross-sectional view taken substantially along line 4—4 of FIG. 1 showing the arrangement of the boot in more detail when fitted over the claw end of the hanger.

The receiving or open end 28 is further defined by an annular, peripheral, embossed, flange member 32. Thus, it can be seen that a corresponding bore 34 is formed by sleeve 26. Although bore 34 can be in any general shape or configuration, the two preferred configurations are herein shown. One such configuration basically requires opening 28 of bore 34 to be larger than the inner terminated end 36. Thus, bore 34 is provided with a tapered inner wall. This allows boot 24 to be readily mounted over claw member 20 of bracket sections 14 and 16. The lower section 38 of bore 34 is preferably formed having a diameter equal to or slightly less than the diameter of the metal rod used in forming the brackets. With this arrangement, a very firm grip is established to the claw by the boot. Because of the enlarged upper section of bore 34, boot 24 can be readily forced over the bent portion of claw 20, as seen in FIG. 4. Further, the enlarged bell end of boot 24 is free to move so as to accommodate the various thicknesses of plates.

Figure 3:
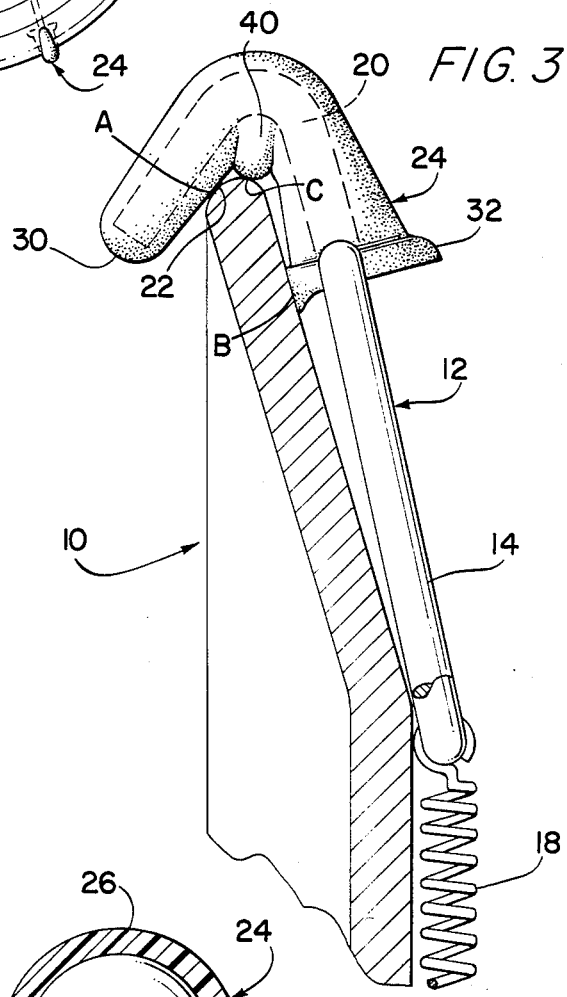
FIG. 3 is an enlarged cross-sectional view taken substantially along line 3—3 of FIG. 1 showing in detail the engagement between the rim of a plate and the boot.

FIG. 3 illustrates how the boot engages the peripheral edge 22 of plate 10. Thus, it can be seen that plate 10 makes a firm but gentle contact with the boot, particularly at point A and point B, and sometimes at point C—point C being defined by an outwardly projecting fold 40 that is generally formed at the time boot 24 is mounted to claw 20. Such an engagement at these points eliminates the problem of wear or damage to these usually very expensive collector plates.

Figure 5:
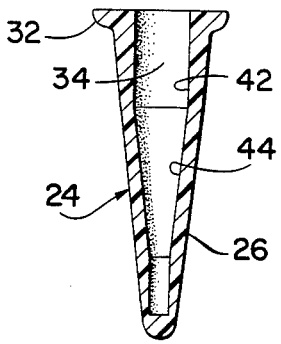
FIG. 5 is a cross-sectional view of an alternative arrangement of the present invention.

FIG. 5 is an alternative arrangement of the inner bore 34 wherein the bore is formed having three varying inner sections. The upper open end section 42 is formed having the largest diameter, the second or mid-section 44 tapers downwardly therefrom and has a smaller diameter, and the third or bottom section has a continuous small diameter that is equal to or slightly less than the diameter of claw 20. Thus, it can be understood that various bore configurations are possible to provide the necessary freedom of movement in mounting the boot to the bracket claw.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. A protective boot in combination with a dish or plate-mounting bracket, comprising:

a bracket including a first bracket section and a second bracket section, each section having claw members which are hooked over the peripheral edge of said dish or plate;

spring members connecting said bracket sections together, and clamping said brackets to said dish or plate;

a protective boot member adapted to be mounted over the respective claws to protect said edge of said dish or plate from direct engagement with said claw, said boot comprising:

a sleeve-like body member having an embossed, annular, peripheral flange member including a central bore having an open end and a closed end, said open end having a larger diameter than that of said closed end, whereby the reduced-diameter portion of said bore fixedly engages said claw member, allowing said enlarged open end to move freely for engagement with said dish or plate;

said bore being tapered inwardly from said open end to said closed end;

wherein said body member is tapered downwardly and inwardly from said peripheral flange to said closed end, allowing said protective boot member to bend to conform to the configuration of said claw and said peripheral edge of said dish or plate.

* * * * *